United States Patent [19]

Sullivan

[11] Patent Number: 4,497,076

[45] Date of Patent: Feb. 5, 1985

[54] DUAL FLUSH SYSTEM FOR CONTROLLING FLUSH WATER IN WATER CLOSET

[76] Inventor: Donald E. Sullivan, 1493 Fahlander Dr. S., Columbus, Ohio 43229

[21] Appl. No.: 469,256

[22] Filed: Feb. 24, 1983

[51] Int. Cl.[3] ..... E03D 1/34

[52] U.S. Cl. ..... 4/392; 4/395; 4/393

[58] Field of Search ..... 4/417, 395, 393, 392, 4/394, 397, 396; 137/403–404, 427; 251/48

[56] References Cited

U.S. PATENT DOCUMENTS

| | | | |
|---|---|---|---|
| 2,598,967 | 6/1952 | Bennett | 4/417 X |
| 2,741,775 | 4/1956 | Schmidt | 4/393 |
| 3,733,618 | 5/1973 | Wiagand | 4/393 |
| 3,935,598 | 2/1976 | Schmidt | 4/393 |
| 3,955,218 | 5/1976 | Ramsey | 4/393 |
| 3,969,775 | 7/1976 | Hazelton | 4/393 |
| 4,000,526 | 1/1977 | Biela et al. | 4/393 X |
| 4,028,748 | 6/1977 | Schoepe et al. | 4/393 |
| 4,189,795 | 2/1980 | Conti et al. | 4/394 X |

*Primary Examiner*—Henry K. Artis
*Attorney, Agent, or Firm*—Frank H. Foster

[57] ABSTRACT

The invention is an improved, adjustable ball valve closure for use in a dual flush water closet which allows the choice of a regular flush or a water saving flush. The adjustable closure is the type having a buoyancy chamber with a relatively lower drain hole and a relatively higher air bleeder port. It is improved by providing a water inlet port in a position which is above the drain hole when the valve closure is closed and is lower than the air bleeder port when the valve closure is open. The improvement allows a finer, more accurate adjustment of the amount of water discharged for a limited flush.

7 Claims, 16 Drawing Figures

DUAL FLUSH SYSTEM FOR CONTROLLING FLUSH WATER IN WATER CLOSET

FIELD OF THE INVENTION

This invention relates to a water inlet control mechanism and a discharge valve closure for use in a water closet or a toilet fixture which conserves water by permitting a choice of full or partial flushes while maintaining quality water closet operation. More particularly, the invention relates to an apparatus which permits both the toilet bowl and the tank to be properly filled during both flushes without causing overfilling and waste of water on either flush and to a discharge valve closure which adjustably controls the water quantity used during a partial flush.

BACKGROUND ART

Water has become increasingly recognized as an important natural resource of limited availability in some geographical areas making conservation measures desirable.

The conventional water closet includes a water storage tank, a waste receipt bowl and passageways for creating siphoning or jet action by the rapid release of water from the water storage tank. Traditionally such water closets have been designed to empty the entire contents of the water tank each time the flushing actuator is operated. However, it is now known that less than the entire water contents of the tank is needed to adequately purge the waste receiving bowl of liquid wastes and refill it with clean water. Usually, however, the entire water content of the tank is needed for removal of solid wastes.

A large variety of devices have been suggested for conserving water in the flushing operation. Some, such as the device illustrated in my earlier U.S. Pat. No. 4,145,774, have two selectable modes of operation. In one mode a flush is initiated which utilizes all of the water in the tank. In the other mode a flush is initiated which uses only part of the stored water. Other types of devices have only one mode of operation in which less than the entire tank volume is utilized.

One popular type of discharge valve closure is the type shown in U.S. Pat. No. 4,028,748. It has a unitary molded body forming the sealing portion, which sealingly engages the valve seat of the discharge valve, and a buoyancy chamber which extends downwardly and has a drain hole at the bottom. When such a conventional discharge valve closure is in the closed position, water drains from the buoyancy chamber. When the valve is lifted by operation of the actuating arm, it is buoyant and remains raised with the valve open until the water level lowers below the discharge valve thereupon permitting the discharge valve to fall by gravity back into the closed position upon the valve seat.

Similar operation is obtained by the valves shown in U.S. Pat. No. 2,741,775 and 2,598,967. These devices have no buoyancy chamber but instead rely upon a lightweight foam material for buoyancy.

Other inventors discovered that the conventional discharge closure of the type having a buoyancy chamber can be made to close prematurely, that is before the water level falls below the level of the discharge valve closure, by providing a small bleeder port in the buoyancy chamber above or below the sealing portion of the discharge valve closure. In some, with the bleeder port above the seal, a snorkel extends upwardly above the water surface level of the filled tank.

In those with a bleeder hole below the seal, preferably the bleeder hole is formed so that it will be facing upwardly when the discharge valve closure is raised to its full open position.

These structures permit the escape of air from the buoyancy chamber so that water may enter the chamber and reduce the buoyancy of the closure to the point that the valve will fall closed before the entire tank contents has been exhausted through the discharge valve. Such structures are shown in U.S. Pat. Nos. 3,935,598; 3,969,775; 4,000,526; and 4,189,795. A check valve is used to control the discharge valve closure disclosed in U.S. Pat. Nos. 3,733,618 and 3,935,598.

Some devices permit no adjustment for controllably varying the rate of water inlet into the buoyancy chamber which rate determines the rate of change of the buoyancy of the closure and therefore determines the water level at which the discharge valve will fall closed. One device provides a float arrangement attached to the valve for adjustment purposes. Still others provide adjustment by a variety of structures for varying the drain hole size by a type of a manually adjustable valve means. Others change the drain hole size by providing a plurality of interchangeable inserts having orifices of different sizes. Ordinarily the size of the bottom drain hole is adjusted in the prior art units.

U.S. Pat. No. 3,324,482 discloses an adjustment valve mechanism with a threaded screw in the bottom wall of the valve closure for controlling the flow rate of water entering the buoyancy chamber through the drain hole. This valve is not intended to be closed completely because that would prevent drainage of the buoyancy chamber when the valve closure reseats at the end of the flush cycle and therefore it would not operate. In U.S. Pat. No. 4,189,795 a variety of other mechanisms for adjusting the drain hole size are disclosed including a bottom wall containing a threaded, adjusting screw and a drain opening that is mated with a vertically movable sleeve adjustment.

My prior U.S. Pat. No. 4,145,774 utilized a buoyancy chamber with a bleeder hole system but combined it with a unique bistable handle to give improved modes of operation.

It is desirable that an adjustment be provided for the discharge valve closures having a bleeder port in order to permit the adjustable selection of the water level at which the discharge valve closure will prematurely close. Such adjustment is desirable to compensate for variations in the tank structures of different toilet manufacturers, to compensate for the different needs of different sewage and water systems and to permit the owner to select the water volume which the owner desires to utilize when obtaining a reduced water volume flush.

However, the adjustment systems which have previously been suggested are difficult to adjust especially for people of limited dexterity or mechanical ability and are subject to the deposit of minerals and other materials which interfere with their operation. Additionally, it is not only more difficult for the owner but more expensive for the manufacturer to provide a plurality of interchangeable drain hole inserts or other additional parts for an adjustable orifice. Finally, drain holes which are adjustable in size are more sensitive to the effect of deposition of materials such as particles or mineral deposits which will further constrict the size of the orifice.

Water closets with very small tanks will sometimes flush improperly with a valve closure using a bleeder hole system. It is therefore desirable to provide a replacement closure that also permits the bleeder to be turned completely OFF. Such an embodiment, to be functional, requires that the air bleed be shut off in a way that will not impede the closures ability to properly drain after reseating on the valve seat at the end of a flush cycle so it will be buoyant. Such an embodiment must not permit the build up of sedimentation in the bottom of the buoyancy chamber.

There is, therefore, a need for a discharge valve closure which can be adjusted for selection of the desired water level at which the valve will close and yet which is simple, inexpensive and easy to manufacture and does not require interchangeable parts.

Previous dual flush devices have worked more efficiently when a reduced flush was done after a full flush cycle because the bowl is filled to its maximum water level at the end of a full flush. Conventional ballcocks (or filler valves) are presently made in various designs which direct a minor portion of incoming water into the overflow tube from which it flows into the bowl and a major portion of the incoming water directly into the tank. They are engineered to refill the bowl in the time it takes to refill the tank after having been drained completely from a conventional full flush cycle.

However, after a partial or limited flush, not as much time is needed to refill the tank because less water was used and therefore less water is directed into the bowl. Consequently in small fixtures the bowl, after a short flush, has insufficient water to initiate the strong siphon or draining action which is desired to remove all the bowl contents after each flush.

One system for assuring that the bowl will be completely filled after either type of flush would be to merely permit a greater rate of water flow through the overflow pipe into the bowl by making the minor water outlet orifice larger. Although this would cause the bowl to always be filled by filling it quicker, after the bowl has been filled following a full flush and while the tank is still filling, excess water will be directed into the bowl and drain out into the sewer. This reduces the water savings from a dual flush system.

There is therefore a need for an apparatus which can easily be retrofit to dual flush water closets and which causes the bowl to be filled to its maximum desirable height after both types of flushes without wasting water after either.

BRIEF SUMMARY OF THE INVENTION

A dual flush bleeder system discharge valve closure is improved in accordance with the present invention by forming a water inlet port through a wall of its buoyancy chamber and, in a closed position of the closure, positioned below the area of sealing engagement of the closure to its valve seat and above the drain hole and, in the opened position of valve closure, positioned lower than its air bleeder port. The port is made adjustable by a cooperating valving means to permit manual selection of the effective port size.

In order to provide for the proper filling of the bowl during both a full and partial flush without overfilling after either flush, the invention comprises aiming the small water conduit provided on a ballcock for the purpose of directing water into the overflow tube so that the stream of water from it is directed near the top inlet of the overflow tube. A deflector is mounted for movement to and away from a bowl filling position at which the stream is directed into the overflow tube and a tank filling position at which the stream is directed into the tank. A buoyant float is linked to the deflector and arranged to move the deflector into its bowl filling position when the tank water level is between its full level and the lowest level it reaches during a partial flush and for moving the deflector to its tank filling position when the tank water is lower. A flow rate control orifice for the small water conduit is selected to permit filling of the bowl during a partial flush. In the alternative, the small water conduit may itself be raised and lowered by the buoyant float to direct the water in the same way.

The principal object of the invention is to provide a more efficient flush and tank refill system.

Another object of the invention is to provide a discharge valve closure which is compatible with my previously invented dual flush system and can be easily installed as original equipment or retrofit on existing water closets.

A further object of the invention is to provide such a valve closure which can be easily and reliably adjusted without requiring any interchangeable parts.

Yet another object of the invention is to provide a discharge valve closure which can be operated as a dual flush system or in the alternative, can be turned off so that it operates identically to conventional discharge valve closures.

Yet another object of the present invention is to provide a valve closure that drains reliably and is less likely to warp and leak.

Other objects and features of the invention will become apparent in view of the following specifications and claims.

Figure 1:
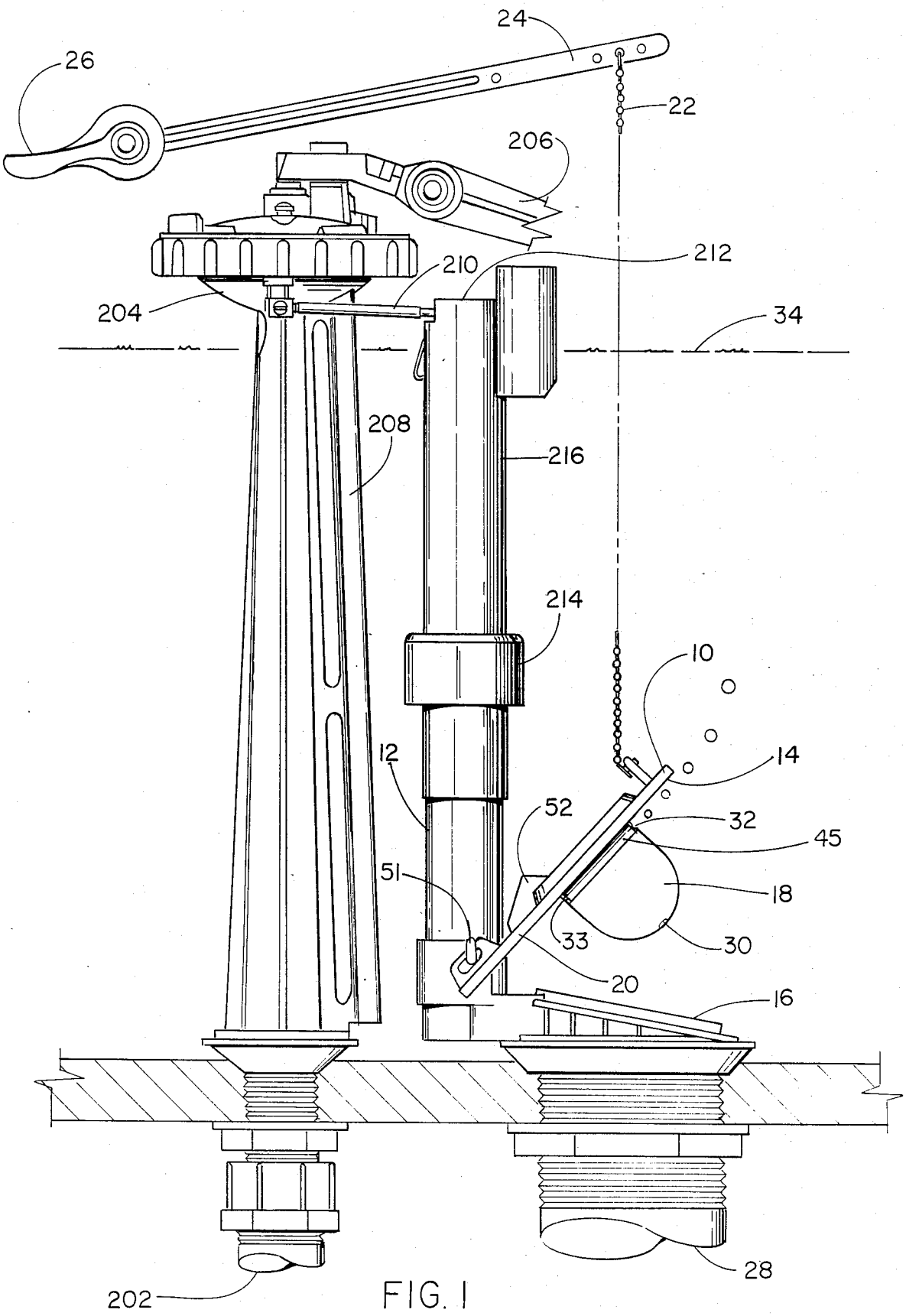
FIG. 1 is a view in side elevation showing the components of a complete automatic, dual flush system mounted in a water tank and embodying the present invention.
Figure 2:
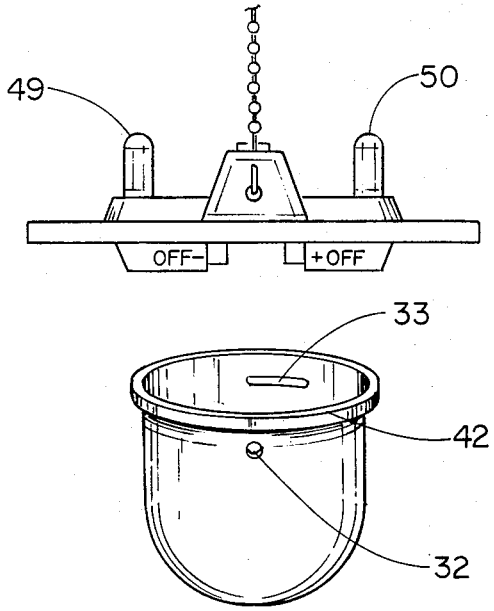
FIG. 2 is a front exploded view of the preferred discharge valve closure embodying the present invention.

In describing the preferred embodiment of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DESCRIPTION OF THE PREFERRED EMBODIMENT

Adjustable Discharge Valve Closure

FIG. 1 illustrates the discharge valve closure 10 mounted in a water tank and directly connected to an overflow tube 12 for pivotal movement. Its annular sealing portion 14 sealingly engages the valve seat 16 when the entire discharge valve closure 10 pivots downwardly. The discharge valve closure 10 also has a buoyancy chamber portion 18 extending downwardly from it and a mounting arm member 20 connected to the overflow tube 12.

The discharge valve closure 10 is linked through a conventional chain 22 to a lever arm 24 which is fixed to a pivot extending through the wall of the water tank (not shown) into connection with the actuating flush handle 26. The lever and flush handle arrangement may be of the conventional type or alternatively may be the type described in my U.S. Pat. No. 4,145,774. In either case, depression of the end of the handle 26 raises the discharge valve closure 10 to permit the water to begin flowing out through the discharge drain 28.

The buoyancy chamber 18 is provided with a drain hole 30 in its bottom and a small air bleeder hole 32 and an adjustable inlet port 33 both of which are relatively higher than the drain hole 30. All three openings through the wall of the buoyancy chamber 18 are positioned below the sealing portion 14 in the closed position of the valve closure 10.

With a conventional lever arm 24 and handle 26, a full flush utilizing all of the water in the tank is accomplished by depressing the handle 26 and holding it down until all of the water has exhausted from the water tank. The handle is then released and the discharge valve closure falls closed to permit the tank to refill.

A short or reduced water volume flush is accomplished by depressing the conventional handle 26 and then releasing it permitting the lever 24 to fall downwardly. Then, as the water level 34 falls, a simultaneous triple action takes place within the buoyancy chamber as the water enters the buoyancy chamber through the drain hole 30 and the inlet port 33 while air bubbles out and upwardly from the bleeder hole 32.

When the net buoyancy of the discharge valve closure and any remaining trapped air becomes negative, the discharge valve closure falls into sealing engagement against the valve seat 16. The triple action tends to make the discharge valve closure very stable during the flush cycle and the bleeding rate more reliably consistent without increasing the cost of producing the discharge valve closure.

If the handle and lever arm are constructed as disclosed in my U.S. Pat. No. 4,145,774, a full flush utilizing all of the water in the tank is accomplished by depressing the handle 26 and releasing it so that the lever arm remains biased in its upper bistable position. In order to accomplish a reduced water volume flush, the actuating handle is immediately raised after being depressed.

As illustrated in more detail in FIGS. 2 through 6, the portion of the buoyancy chamber 18 which extends below the sealing portion 14 is a separate receptable 40. Preferably, the separate receptacle 40 is a relatively rigid, plastic receptacle having the drain hole 30 formed at the bottom thereof with the two relatively higher, opposite openings for water intake and air release. The separate receptacle 40 has an outwardly extending annular flange 42 around its top. The underside of the remainder part 44 of the valve closure 10 is provided with a mating shoulder 45 which may be a part of an inwardly opening annular groove 47 which receives the annular flange 42. This permits the separate receptacle part 40 to be frictionally held but manually pivoted or rotated within the remainder part 44.

The innermost ring 39 helps to grip and seal the flange and prevents the chamber from eventually falling out after continually falling closed when filled with water. It also helps to maintain the proper amount of friction for the rotatably adjustable chamber.

Two segments are removed from the annular shoulder so that the remaining shoulder forms a "window" and operates as a valving means one "window 46" in the rear cooperating with the inlet port to adjust its effective size by rotation of the separate receptacle 40. The other removed segment forms a a "window 49" in the front to provide a visible reference when rotating the separate receptacle 40 and to permit blockage of it to shut it off. Also, the upper and outer portion of the buoyancy chamber wall can be made thicker and tapered so as to be flush with the annular sealing portion of the closure to guide the closure onto the valve seat if they are misaligned.

The water inlet port 33 is preferably nearly opposite the air bleeder hole 32 but it is slightly off center. The annular elastomeric portion provides a tight friction fit against the rear chamber opening to prevent the water inlet adjustment from leaking during the flush cycle so that the elastomeric portion can operate as an adjustable valving means to adjust the size of the inlet port.

The diameter of the air bleeder hole 32 works well at 0.125 inches because this opening is large enough not to become easily obstructed but small enough to be reliable and sensitive to the water intake adjustment. This size air bleeder hole is also large enough to be seen from above the tank when rotated for adjustment.

Since the rear water inlet port is adjustable, its shape and measurements can vary somewhat. However, a desirable size for the inlet port 33 is 0.375 wide and 0.0635 deep. The elongated inlet port rotates within the "window" opening which is approximately 0.4062 wide.

A width for the air bleeder hole "window" of 0.5 has proven satisfactory in order to synchronize the adjustment indicator (the air bleeder hole 32) with the actual adjustment of the inlet port. Both "windows" would be approximately 0.25 deep and can be open at the bottom since they would be formed from removed segments of the annular elastomer portion surrounding the top of the separate receptacle 40.

The bottom drain orifice of the buoyancy chamber functions well at 0.1406 inches. Both it and the adjustable water inlet port 33 will be taking in water simultaneously during the flush cycle for all the adjustments except OFF and therefore their cooperative effect must be considered.

If it should be desirable to deviate from one or more of the above dimensions to accommodate a different type of tank exhaust valve closure the diameter of the bottom drain orifice should be changed relatively little and instead the sizes for the other openings should be changed.

The 0.1406 inch diameter of the bottom drain orifice is large enough to properly drain the chamber to preserve buoyancy and to prevent sedimentation from building up in the bottom area of the chamber but it is also small enough to temporarily trap the water in the chamber as the ball slowly closes at the termination of the flush cycle. The size of the bottom drain opening does not change when adjusting the water inlet port. It is sufficiently small that not much water is drained from the buoyancy chamber prematurely as the valve closure starts to close at the end of the flush cycle. Excessive water draining from the chamber would cause the ball to lose some of its gravity force while closing which assists the ball in overriding the spring force exerted by the bistable handle which forms a part of the invention of my prior patent and is preferably used with embodiments of the present invention.

Figure 3:
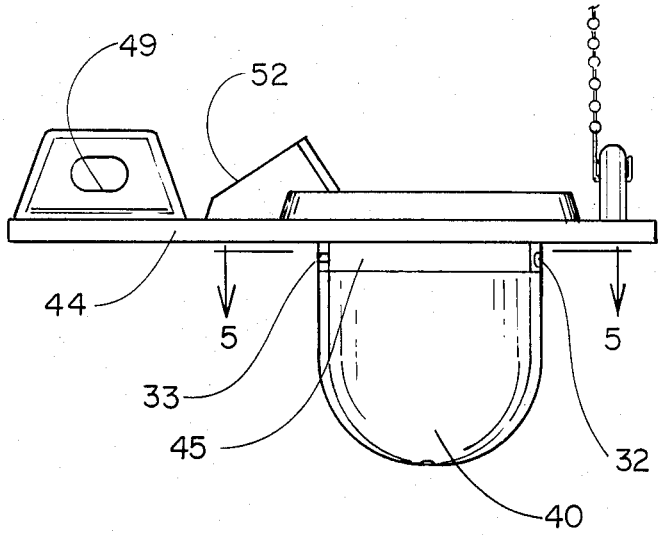
FIG. 3 is a view in side elevation of the embodiment illustrated in FIG. 2.
Figure 4:
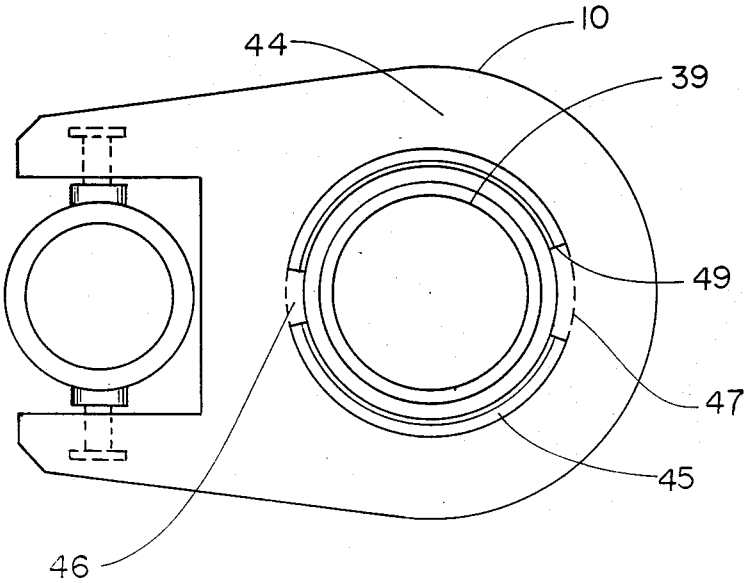
FIG. 4 is a bottom view of the elastomeric portion of the embodiment of FIG. 2 and having a retrofit rear attachment.
Figure 5:
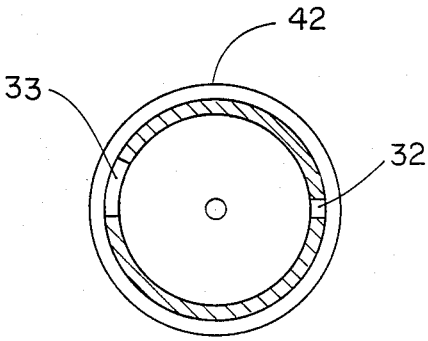
FIG. 5 is a view in horizontal section of the buoyancy chamber of the embodiment of FIG. 2 taken substantially along the line 5—5 of FIG. 3.

Retrofit attachment is made more adaptable by the improved shape of the elongated holes 49 shown in FIG. 3. The space between the opening of the discharge valve and the protruding trunnions 51 may vary slightly with different manufacturers. The purpose of the elongated holes shown in FIG. 3 is to permit the valve closure to self-adjust each time that it reseats. The vertical dimension of the holes is conventional so that it will not come loose from the trunions or retrofit collar. This improvement provides for a more dependable closing action when the ball is attached to the overflow pipe trunnions or the collar attachment so that it will work well in a large variety of tank systems.

While the retrofit attachment that is shown is designed to fit some of the most common tank systems, it is contemplated that various attachments to retrofit additional fixtures can be provided easily without changing the discharge valve closure.

Shown in FIGS. 1 and 3 is a solid, narrow protruding stop means 52 that makes contact with the overflow tube (in tanks that have one) when the closure is in its highest open position. The stop assures that the closure will travel the same distance downward each time it closes to make the tank water level at which it closes during a short flush consistently the same. Since the closure is designed to bleed virtually all of the air from the buoyancy chamber area before closing, it is important that the stop be made of solid material. The stop also assures that when the closure is in its uppermost position it does not come into contact with the float of the tank fill control.

The tank water level of the full flush is adjusted in the conventional manner by raising or lowering the ballcock float or float cup. The tank water level of the short flush cycle is adjusted by rotating the buoyancy chamber indicator (or air bleeder hole) toward the plus or minus symbols. Turning the indicator hole toward the plus symbol raises the tank water level at which the closure drops closed and turning the hole toward the minus symbol lowers the tank water level at which it closes.

In the preferred embodiment when the rotatable bleeder hole is in the center of its "window" the ball is set at the middle of its short flush adjustment range thereby releasing about one-half of the water volume contained in an average size tank.

The short flush adjustment is accomplished for a particular size tank by the trial and error system of positioning the air bleeder hole, with respect to the sides of its "window" as points of reference, and then observing the amount of water in the tank when the discharge valve closure falls closed. If the water level is lower than desired at the time the valve closure closes, then the bleeder hole should be rotated toward the plus symbol to open the rear intake valve which shortens the flush cycle and traps more water in the tank. However, if the water level is higher than desired, the bleeder hole is rotated away from the plus symbol toward the minus symbol which in effect reduces the water intake capacity of the water inlet port to slow or delay the closing of the discharge valve closure until more water has been discharged from the tank.

While only two "windows" and their related openings are shown in the preferred embodiment, more of both can be easily added. Additional windows and related openings (of various sizes and shapes) can be placed almost anywhere within the 360° without departing from the scope of the invention. In this case some of the additional "windows" and openings might be for air bleeding purposes and some for water inlet purposes depending on their location.

An alternative is to completely eliminate the air bleed hole and substitute a snorkel type air line in its place with any of the illustrated embodiments as illustrated in my prior patent.

Also it should be understood that the buoyancy chamber, when molded in rigid material, can be made in a variety of shapes and designs. The rear wall could be made flat. The water inlet port could be adjusted vertically from either above or below. In some less conventional discharge valve closure designs, this opening can be made angularly adjustable.

In describing the discharge valve closure operation, there are two water levels that must be considered. They are independent of each other and travel in opposite directions during the flush cycle. While the water level within the tank is dropping the level within the buoyancy chamber of the closure is rising.

Figure 6:
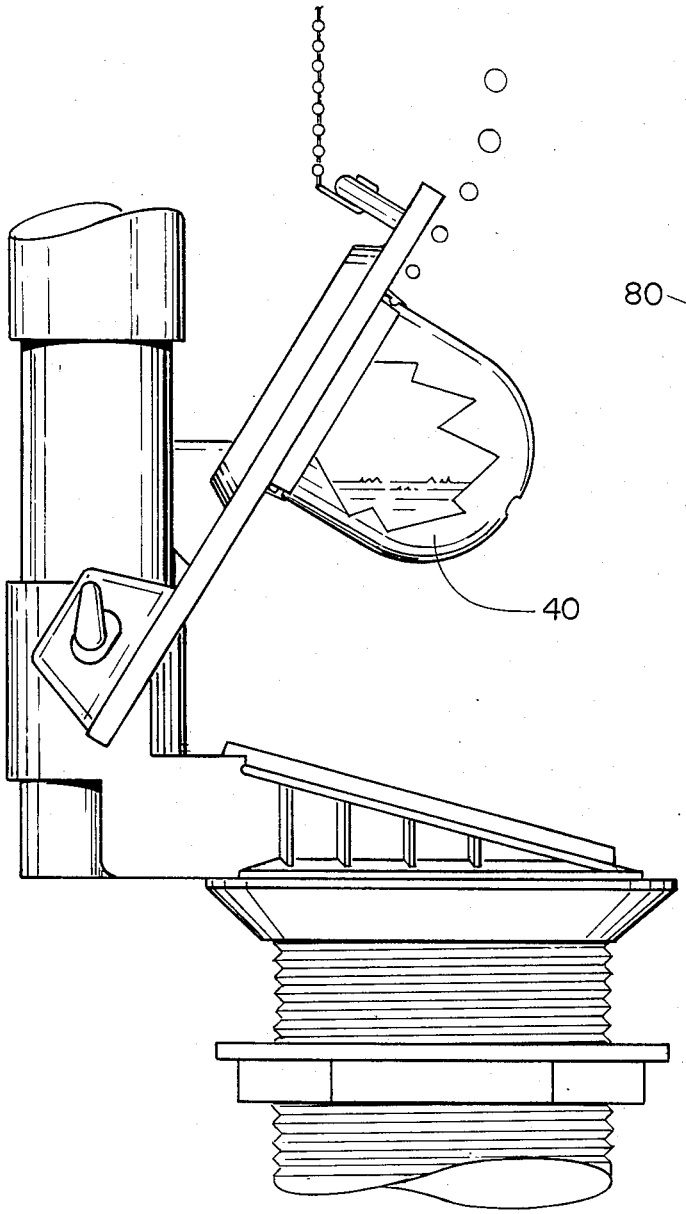
FIG. 6 is a side view of the preferred discharge valve closure of FIG. 2 showing the closure in its uppermost position at the beginning of a flush cycle.

Turning to FIG. 6 (with the ball in its highest open position) it can be seen that the water inlet port is preferably located anywhere below the broken water line surface. It can be placed in the side of the buoyancy chamber or even in the lower front area. The higher that the inlet port is placed above the broken line water surface level the less effective it is in controlling the bleeding of air until the chamber becomes filled to the level of the water intake opening. This is because, until the water level in the chamber reaches the level of the inlet port, the inlet port may act as an air bleeder hole.

It can be seen that one advantage of the present invention is that the water inlet port can be adjusted without interfering with the drain hole so the drain hole can still function properly as a drain hole.

Figure 7:
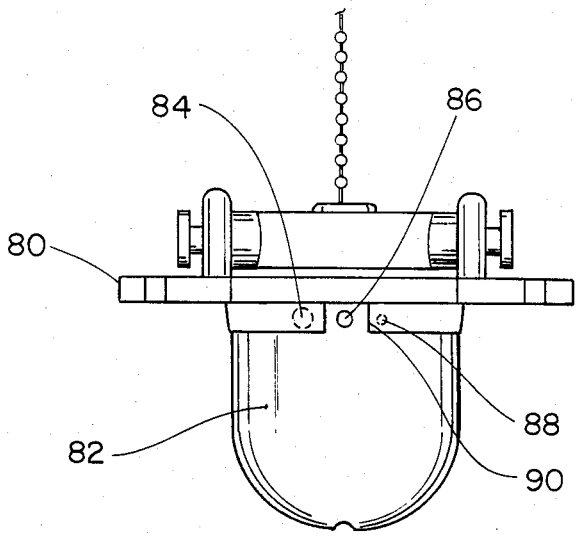
FIG. 7 is a view in rear elevation of an alternative embodiment of the invention.

FIG. 7 illustrates a discharge valve closure 80 with a rotatable receptacle 82 like that shown in FIGS. 1–6. However, instead of a single water inlet port it is provided with three discrete water inlet ports 84, 86 and 88 of differing sizes. These three ports are spaced a distance essentially equal to the width of the "window" 90 so that only a portion of two holes or a whole single hole is able to intake water at any adjustment.

This embodiment of FIG. 7 may be adjusted by exposing only a portion of the small hole, all of the small hole, a portion of the small and a portion of the medium hole, all of the medium hole, a portion of the medium and a portion of the large hole and all of the large hole. In each case the effective size of the inlet port is adjusted by rotating the separate receptacle 82.

Figure 8:
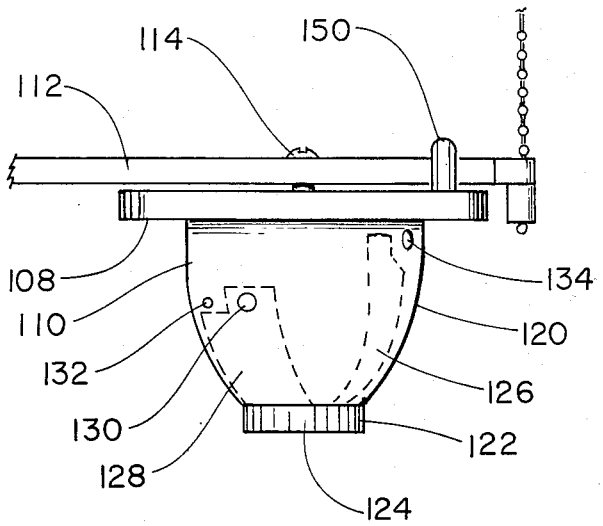
FIGS. 8, 9 and 10 are views in side elevation of other alternative embodiments of the invention.

FIG. 8 illustrates the buoyancy chamber 120 of a discharge valve closure 110 mounted to a mounting arm 112 by means of a central screw 114. It has a sealing portion 108 and is provided with stops 150 and 151 on opposite sides of the mounting arm 112 so that the buoyancy chamber 120 cannot rotate relative to the support arm 112.

The bottom of the buoyancy chamber 120 is provided with a rotatable insert 122 having a central hole 124 forming the drain hole for the discharge valve closure. However, the insert 122 is rotatable and has a pair of upstanding panels 126 and 128 which connect to the insert 122 and rotate with it. These panels 128 form valving means and are rotated to adjust the effective size of the plurality of water inlet ports such as ports 130 and 132 which are visible. Additionally, the panel 126 can be rotated to seal the air bleeder hole 134 in the event that the discharge valve closure is used in the conventional manner.

Figure 9:
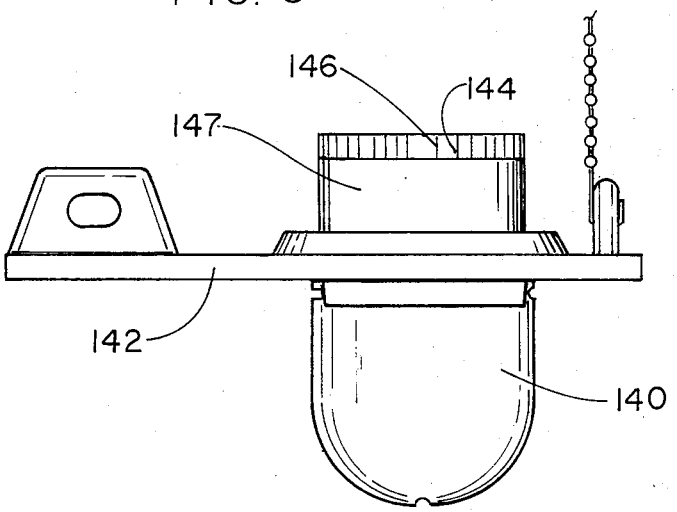

FIG. 9 illustrates a discharge valve closure which operates in the same manner as the embodiment of FIGS. 1–6. However, unlike the embodiment of FIGS. 1–6, its buoyancy chamber 140 is formed of a unitary body which extends up through the elastomeric portion 142 to a dial portion 144. With this construction, the buoyancy chamber 144 may be rotated from above by turning the dial portion 144 rather than requiring an individual to grasp and rotate the buoyancy chamber from below the elastomeric portion 142.

Additionally, if desired with the embodiment of FIG. 9, the buoyancy chamber may be divided into chambers by a wall separating the lower buoyancy chamber below the elastomeric portion from the portion above the elastomeric portion. Desirably, the upper chamber may be provided with at least one hole 146 which merely assures that air cannot be trapped in the upper chamber 147 to increase the buoyancy. As ah alternative, the lower buoyancy chamber 140 and the upper separate chamber 147 can be made in relatively movable pieces and adjustable panels like those illustrated in FIG. 8 may extend down to adjust the size of the water inlet port in the manner similar to that of FIG. 8, only the adjustment is made from the top.

As yet another embodiment, which is not illustrated, a surrounding groove can be formed around the outer surface of the buoyancy chamber and the water inlet ports formed through that groove. A ring forming an adjustable valving means may be seated in the groove and also provided with an opening so that the opening through the ring can be adjusted relative to the water inlet opening to permit the manual selection of an effective water inlet port size.

Figure 10:
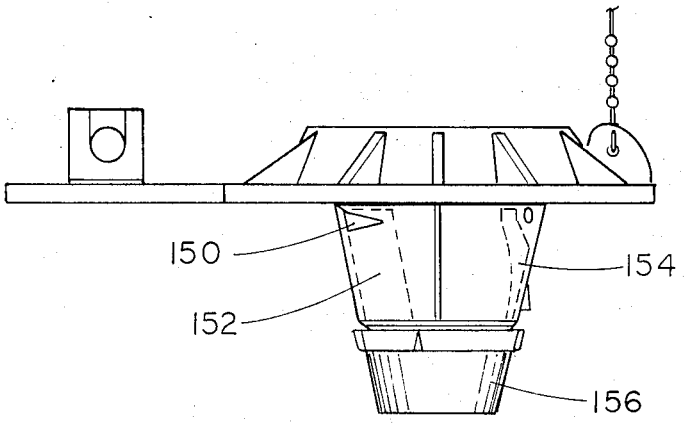

FIG. 10 illustrates a discharge valve closure comprising an upper elastomeric portion and a lower chamber portion of rigid material and operating on the principal similar to the embodiment of FIG. 8 but contoured into a different shape. It is provided with a tapered water inlet port 150 and adjustable valving means formed by panels 152 and 154 which are connected to a bottom dial 156 and rotate with the dial in the manner described in connection with the moving panels of FIG. 8.

Figure 11:
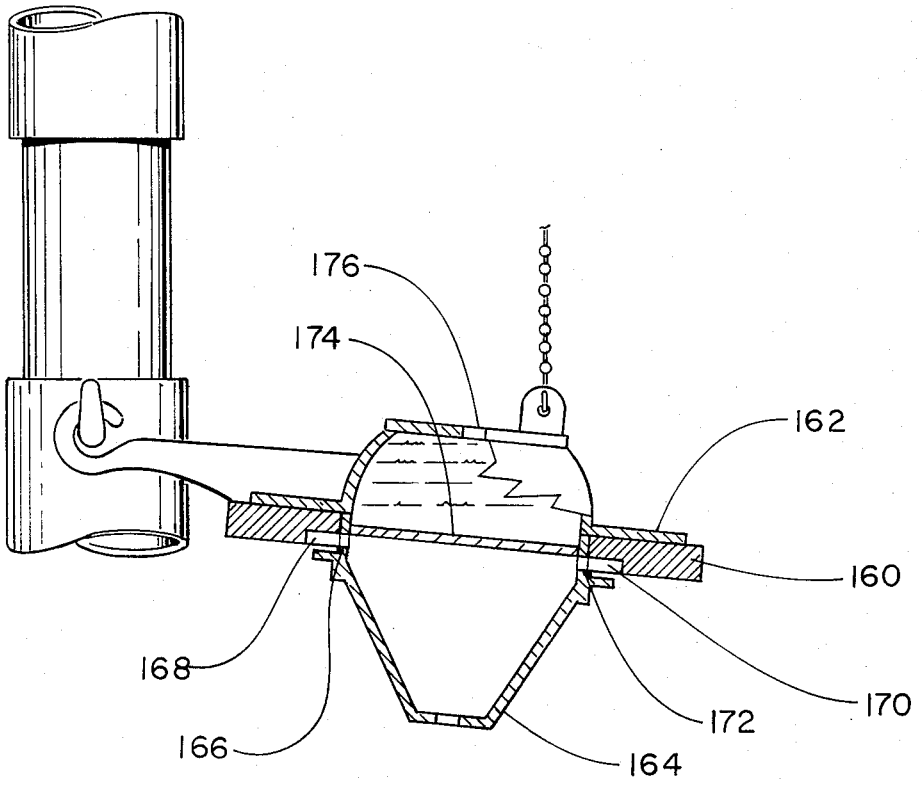
FIG. 11 is a view in side elevation showing another embodiment of the invention made primarily of plastic or resin material and mounted in association with its cooperating valve seat by an attachment notch.

FIG. 11 illustrates a nonrotatable, plastic buoyancy chamber which is provided with an elastomeric sealing ring 160 immediately beneath an annular flange 162. The sealing ring, in addition to its sealing function, can be frictionally engaged to the buoyancy chamber 164 and operate as the adjustable valving means. For this purpose the water inlet port 166 is formed radially inwardly from the sealing ring 160 at the rear portion of the buoyancy chamber 164. A notch 168 in the sealing ring is provided for adjustable registration with the water inlet port 166 to permit manual selection of the effective port size. A similar notch 170 is formed in the sealing ring to provide a "window" for the air bleeder hole 172. As with the embodiment of FIG. 9, the buoyancy chamber 164 may be provided with a partition 174 so that the portion of the valve closure above the sealing ring 160 may be filled with water through a hole 176 to reduce its buoyancy. As an alternative to the upper water chamber, the upper area of the chamber can be plugged with a lightweight nonbuoyant material to provide a low cast ceiling to eliminate the unwanted pocket.

Bowl Filling Apparatus

The short flush cycle can be operated more efficiently if the bowl is completely full when the short cycle is actuated. This eliminates the need for some of the first flush water to be used to fill the bowl. In past dual flush systems, the bowl refill metering of the ballcock has not been engineered to fill the bowl during the time of the short flush cycle as explained above.

The ballcock preferably used with the present invention has a larger refill metering orifice which can be formed when molding the ballcock nipple or provided in the form of an adjustment. If it is made adjustable, the adjustment range should be centered about approximately twice the conventional flow rate so that some adjustment would be available in both directions from the conventionally selected tank water level of one-half for a short flush. New, smaller tanks do not provide as much time to refill the bowl as larger ones do even during a full flush cycle.

The correct metering setting for the bowl refill tube is determined by first adjusting the discharge valve closure to the short flush which is desired. The short flush is tested with the bowl completely filling following a full flush cycle. Once the desired short flush water volume or tank level has been determined, the metering orifice of the ballcock used for adjusting bowl refill is set to completely refill the bowl in the limited amount of time available when the tank refills after a *short* flush.

Except for the tank refill control apparatus of the present invention that ballcock setting would overfill the bowl and waste about 3 quarts of water during the refill time required for replenishing tank water after a *full* flush cycle. The tank refill control apparatus of this invention is utilized to correct this condition and to insure that part of the water that is saved by the dual flush system is not wasted by overfilling the bowl during the full flush cycle.

FIG. 1 illustrates a conventional ballcock arrangement in which water enters through a pipe 202 through the bottom of the water tank and is valved by the ballcock 204. The ballcock is actuated in the conventional manner by a float (not illustrated) attached to a lever arm 206. The ballcock 204 directs a major portion of the incoming water down a pipe 208 where it is emitted into the tank near the bottom. The ballcock 204 also directs a relatively minor portion of the incoming water through a water conduit 210.

In a conventional system, the conduit 210 is aligned to direct water into the upstanding drain pipe 12 and from there flows into the bowl. In the present invention the water conduit 210 cooperates with a deflector and the drain tube 12. The deflector is responsive to the water level in the tank. When the water level is above the lowest level reached by the tank water during a partial flush, water is directed into the overflow pipe 12. However, when the tank level is below that level, water is directed into the tank. This can also be accomplished by eliminating deflector and instead moving the tube to properly direct its stream of water thereby using the overflow pipe as a deflector.

There are two initial choices for a deflector system. First, the water from the water conduit 210 may be directed into the overflow tube 12 and the deflector may serve to deflect it away from that path and into the tank. Conversely, the water conduit 210 may be directed across the top of the overflow tube 12 but into the tank and the deflector may move into position to direct it into the overflow tube. Thus, the water, from the outlet of the water conduit, is directed near the top inlet of the overflow tube. A deflector is mounted for movement to and away from a bowl-filling position at which the stream is directed into the overflow tube and a tank-filling position at which the stream is directed into the tank. A buoyant float is linked to the deflector and arranged to move the deflector into its bowl-filling position by the buoyant force exerted on it by the tank water when the tank water level is between its full level and substantially its lowest level during a partial flush and to move the deflector to its tank-filling position when the tank water level is lower.

Figure 12:
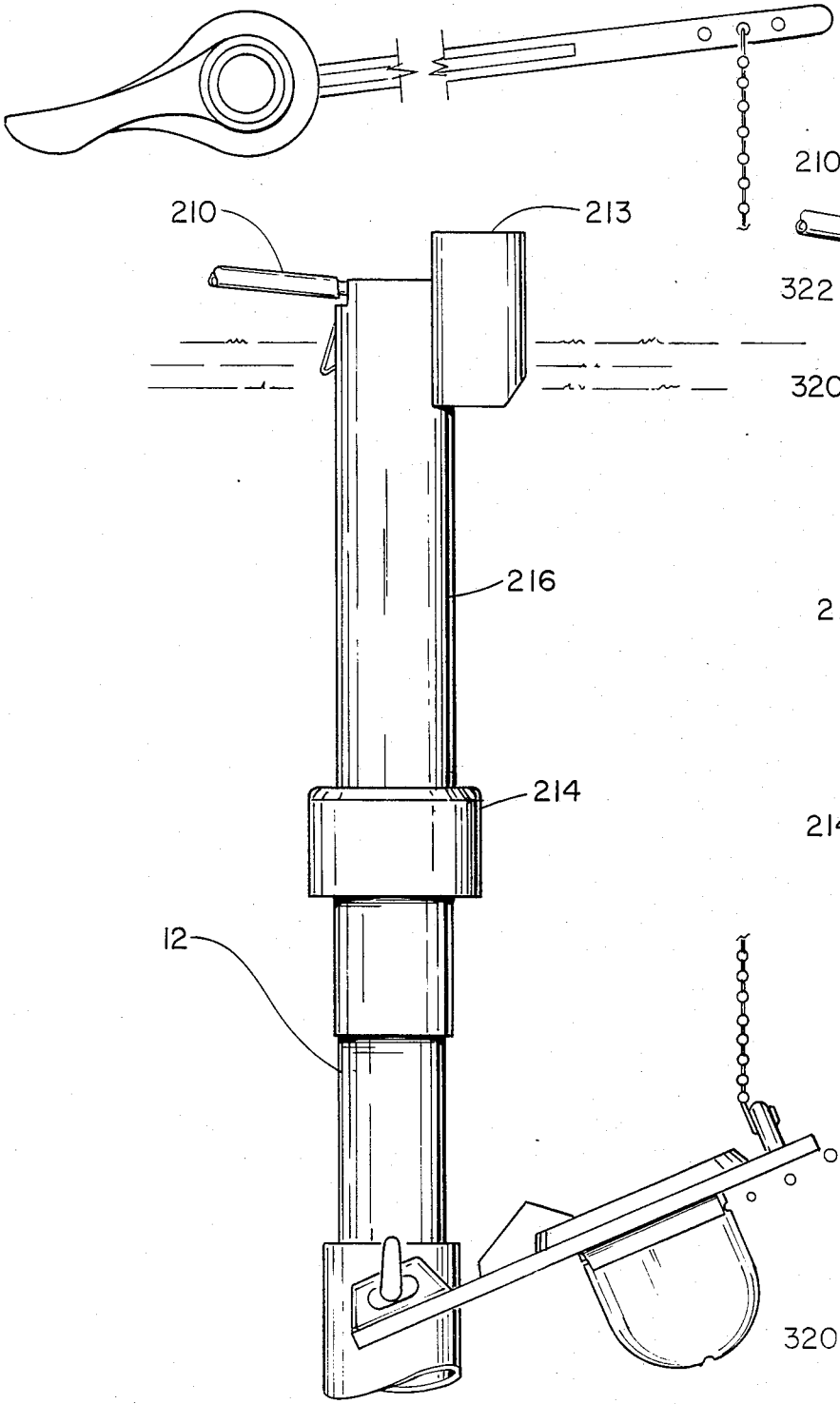
FIG. 12 is a view in side elevation of a tank fill control apparatus embodying the present invention.
Figure 13:
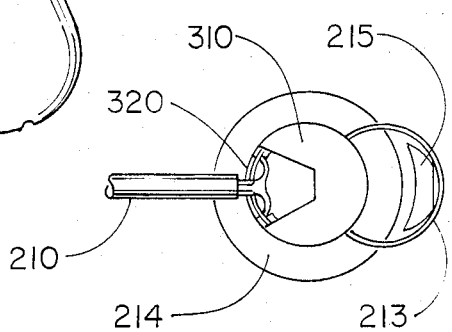
FIG. 13 is a top view of the embodiment of FIGS. 12 and 12A.

In the preferred embodiment illustrated in FIGS. 1, 12 and 13, the water conduit 210 is arranged to direct its stream of water across the top of the inlet tube 12 and into the tank. The deflector 212 and the buoyant float 214 are connected to a sleeve 216 which slideably surrounds the overflow tube 12 to form a vertically reciprocating unit. The deflector is raisable to its bowl-filling position at the top of the overflow tube on the side of the overflow tube distally from the exit orifice of the conduit. At this position it deflects water into the overflow tube. However, when the water falls below the lowest level of the tank water during a short flush, the deflector 212 moves out of the path of the water from the conduit 210 and permits the water to be directed into the tank Therefore, the water directed into the tank is not wasted and merely serves to increase the rate at which the tank is filled. However, when the tank water rises following a full flush, the float lifts the deflector 212 into the stream of water when the tank level reaches the lowest level it reaches during a short flush cycle.

Desirably, the buoyant float is slidably adjustable relative to the sleeve 216 so that the deflector will rise into its deflecting position at the selected water level for a short or partial flush.

Figure 12A:
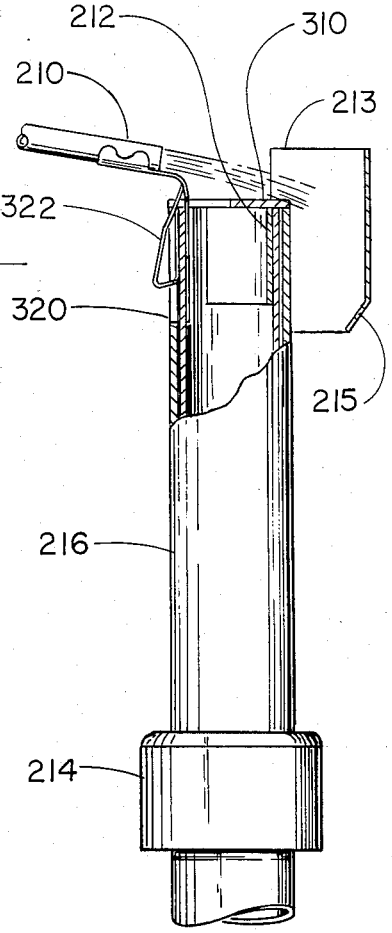
FIG. 12A is a view of a fragment of the embodiment of FIG. 12 illustrating the sleeve in its down position.

FIGS. 12, 12A and 13 illustrate in more detail the water conserving, tank-fill control apparatus of the present invention. In this embodiment the water deflector 212 is arcuate and mounted at its top edge to a cap 310 which is adhered around its periphery to the upper edge of the sleeve 216.

When the water level is below the level of the buoyant float 214, the sleeve slides downwardly to the position illustrated in FIG. 12A. In this position water from the exit orifice of the conduit 210 is directed against a baffle 213 which deflects the water downwardly along the outer surface of the sleeve 216 and into the tank. The bottom wall 215 of the baffle 213 is turned inwardly to deflect the water against the sleeve so that it flows along the sleeve to eliminate the noise of bubbling, turbulent water during refilling of the tank. Alternatively, a bottom wall can be formed at the lower end of the baffle 213 which extends all the way to the sleeve 216 to seal the bottom and form a vessel. A hole can be formed through the sleeve but in communication with that vessel so that water striking the baffle 213 flows between the sleeve and the overflow tube into the tank. This would further reduce the noise.

When the water level in the tank rises sufficiently, the buoyant force upon the buoyant float 214 raises the sleeve 216 and the deflector 212 mounted thereto up to the position illustrated in FIG. 12 so that the deflector 212 occupies the position illustrated in phantom in FIG. 12A. In this position the water from the exit orifice of the conduit 210 strikes the deflector 212 and is directed down inside the overflow tube 12.

A suitable stop is desirably formed so that when the deflector 212 is lifted to its operable position, the buoyant force will lift it no further. In the preferred embodiment a vertically oriented slot 320 is formed in the outer surface of the sleeve 216 immediately below the mounting bracket 322 which conventionally supports the water conduit 210. The slot 320 extends a distance below the bottom of the bracket 322 which distance is equal to the desired distance which the sleeve 216 rises when lifted into the operable position for deflecting water into the overflow tube. Thus, when the sleeve lifts the deflector 212 into its operable position, about $\frac{3}{4}$ inch in the preferred embodiment, the bottom of the slot seats against the bracket 322 and prevents further rise of the sleeve 216. Because the side walls of the slot 320 are on opposite sides of the mounting bracket 322, the slot prevents rotation of the sleeve 216 relative to the overflow tube 12.

The cap 310 which is fastened to the top of the sleeve 216 serves to prevent the upward splashing of water when it is striking the deflector 212 and also operates as a stop to limit the downward movement of the sleeve and the parts mounted to it.

The buoyant float 214 is preferably a cylindrical, short tube having an inwardly flared, upper end which frictionally engages the outer surface of the sleeve 216. Its position is therefore slidably adjustable. The adjustment may be accomplished by first operating a short flush. At the instant the valve closure falls closed the ballcock float is raised to shut off incoming water and secured in that position. At this point the water level will equal the lowest level it reaches during a short flush. The buoyant float 214 is then slidably adjusted until the upper edge of the deflector 212 is at the upper side of the stream of water flowing from the exit orifice of the conduit 210.

Therefore, the operation of this embodiment of the invention will be that, upon a full flush, the sleeve will slide down to the position where the deflector 212 is removed from the path of the water exiting from the conduit 210 so that the water will fall as illustrated in FIG. 12A. The water then rises following a full flush and when it reaches the lowest level to which it would go from a short flush, buoyant forces will lift the deflector 212 into the path of the water coming from the water conduit 210. At this point the remaining water flowing from the conduit 210 will be deflected into the overflow tube 12. On a short flush the water level will never fall sufficiently to lower the deflector 212 out of the path of the water coming from the water conduit 210. Therefore, following a short flush, all water will be deflected into the overflow tube 12.

It should be understood that it is not necessary to locate the tank-fill control apparatus of the present invention about the overflow pipe. For example, in other models of water closets there are other opportunities for other embodiments of the control apparatus of the invention.

Figure 14:
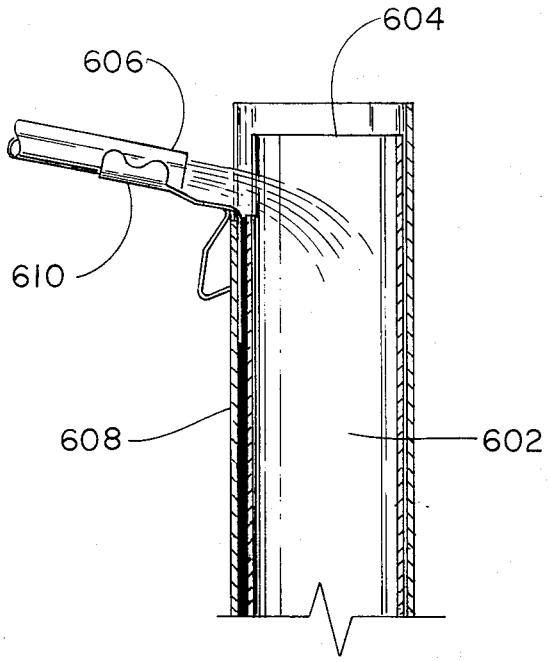
FIG. 14 is a view in vertical section of an alternative embodiment of the tank-fill control apparatus of the present invention shown in its bowl-filling position.
Figure 15:
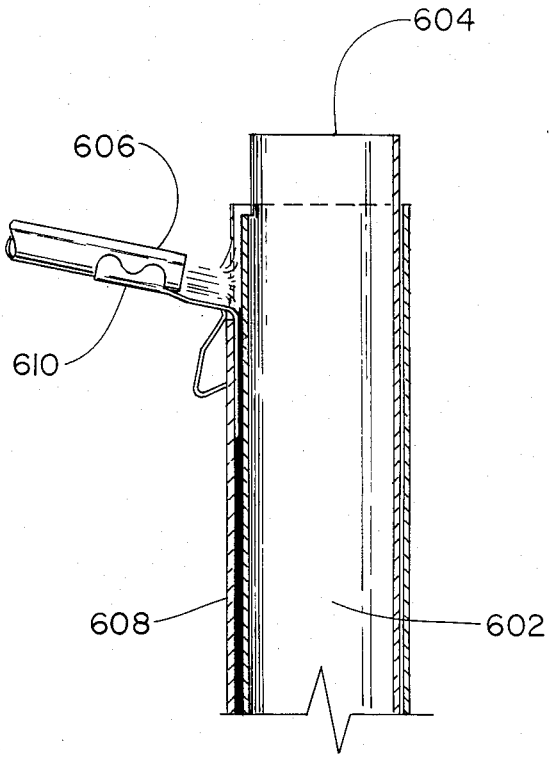
FIG. 15 is a view of the embodiment of FIG. 14 in its tank-filling position.

The water conduit and the water deflecting baffle may be functionally interchanged to form an embodiment in which the conduit is raised and lowered while the baffle remains stationary. This concept is illustrated in FIGS. 14 and 15. In FIG. 14 the overflow tube 602 has an upper portion 604 which extends beyond the usual height of the overflow tube 602. It functions as the water deflector but is immobile.

The water conduit 606 is mounted to a vertically slidable sleeve 608 by means of a mounting bracket 610. The sleeve 608 is concentric with the overflow tube and is connected to a buoyant float identically as shown in FIGS. 12, 12A and 13 and therefore is not illustrated again in FIGS. 14 and 15.

In the embodiment of FIGS. 14 and 15, when the water level is below the lowest level it reaches during a short flush then the sleeve 608 and the water conduit 606 mounted thereto are in the lowered position illustrated in FIG. 15. In that lowered position water from the conduit 606 merely strikes the outer surface of the overflow tube 602 and falls into the tank.

However, when the water rises sufficiently, the sleeve 608 is lifted and with it the water conduit 606 until the conduit 606 is positioned opposite the deflector 604. In that position the water is directed into the overflow tube 602 and falls within the tube down into the bowl.

Whether utilizing a movable conduit or a movable deflector either could be pivotally mounted and linked to the float so that they would pivot instead of translating vertically, to carry out the purposes of the invention.

Also, the tank-filler control apparatus can be used without the valve closure of the invention to correct conventional fixtures which have a ballcock that overfills the bowl.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims:

I claim:

1. An improved adjustable discharge valve closure of the type providing a reduced water volume flush for the tank of a water closet, said discharge valve closure including a sealing portion and a buoyancy chamber portion attached to a mounting arm member which in turn is mounted in the tank for pivotal movement of the valve closure into and out of sealing engagement with the discharge valve seat, said buoyancy chamber portion, in the closed operable position of the valve closure, including a relatively lower drain hole and a relatively higher bleeder port formed through a wall of the buoyancy chamber portion below the area of said sealing engagement when said closure is in its closed position wherein the improvement permits improved manual adjustment and control of the water volume of a flush and comprises a water inlet port formed through a wall of said buoyancy chamber and in said closed position of the closure positioned below the area of said sealing engagement and above said drain hole and, in the opened position of said valve closure, positioned lower than said bleeder port.

2. A valve closure in accordance with claim 1 wherein an adjustable valving means cooperates with said port for permitting the manual selection of an effective port size.

3. A valve closure in accordance with claim 2 wherein said valving means comprises an annular boss extending downwardly from said sealing portion and against the buoyant chamber, said boss having a removed portion forming a window whereby said buoyant chamber may be rotated to selectively cover and uncover said water inlet port by said boss.

4. A valve closure in accordance with claim 2 wherein a water inlet port is formed, in the opened position of said valve closure, below a horizontal plane extending through the uppermost edge of said drain hole.

5. A valve closure in accordance with claim 2 wherein said water inlet port comprises a plurality of spaced discrete ports of different sizes which are rotatably adjustable relative to said valving means.

6. A valve closure in accordance with claim 2 wherein said valving means comprises at least one panel shaped to conform to a wall of said buoyancy chamber and adjustably movable over said water inlet port to vary the effective size of said inlet port.

7. A valve closure in accordance with claim 2 wherein said buoyancy chamber is formed of a unitary body extending above the sealing portion to permit manual rotation of the chamber from above said closure.

* * * * *